US005613882A

United States Patent [19]

Hnatuck et al.

[11] Patent Number: 5,613,882

[45] Date of Patent: Mar. 25, 1997

[54] CONNECTOR LATCH AND POLARIZING STRUCTURE

[75] Inventors: Robert J. Hnatuck; John R. Shuey, both of Mechanicsburg, Pa.

[73] Assignee: The Whitaker Corporation, Wilmington, Del.

[21] Appl. No.: 660,774

[22] Filed: Jun. 10, 1996

Related U.S. Application Data

[63] Continuation of Ser. No. 35,146, Mar. 19, 1993, abandoned.

[51] Int. Cl.[6] ..... H01R 13/62

[52] U.S. Cl. ..... 439/686; 439/372; 439/680

[58] Field of Search ..... 439/345, 350, 439/372, 358, 78, 79, 680, 681, 701, 686

[56] References Cited

U.S. PATENT DOCUMENTS

| | | | |
|---|---|---|---|
| 4,243,289 | 1/1981 | Kozel | 439/701 X |
| 4,506,940 | 3/1985 | Asick et al. . | |
| 4,506,949 | 3/1985 | Knop | 350/162.19 |
| 4,632,492 | 12/1986 | Yamada . | |
| 4,772,227 | 9/1988 | Pelzl et al. | 439/681 |
| 4,773,881 | 9/1988 | Adams, III | 439/681 |
| 4,867,690 | 9/1989 | Thumma | 439/79 |
| 4,873,614 | 10/1989 | Lichtensperger | 439/372 |
| 4,975,069 | 12/1990 | Fedder et al. | 439/101 |
| 4,976,628 | 12/1990 | Fedder | 439/101 |
| 4,984,992 | 1/1991 | Beamenderfer et al. | 439/108 |
| 5,186,645 | 2/1993 | Bixler | 439/358 |

*Primary Examiner*—Khiem Nguyen

[57] ABSTRACT

An electrical connector assembly (6) comprises, a header (7) through which conductive pins (3) extend, a series of parallel keyways (23) in the header (7), an electrical connector (12) for connection to some of the pins (7), at least one external key (24) on the connector (12) being received along one of the keyways (23) to align the connector (12), and a pivotable hook (30) adapted to impinge a ledge (22) of the connector (12).

10 Claims, 3 Drawing Sheets

CONNECTOR LATCH AND POLARIZING STRUCTURE

This application is a Continuation of application Ser. No. 08/035,146 filed Mar. 19, 1993, now abandoned.

FIELD OF THE INVENTION

The invention relates to an electrical connector assembly and a latch for housing blocks of the electrical connector assembly, and more particularly, to such a latch that is adaptable to fit with connectors of different sizes.

BACKGROUND OF THE INVENTION

According to an electrical connector assembly, as disclosed in U.S. Pat. No. 4,506,949, electrical cable connectors of different sizes are connected to respective groups of electrical wires. The number of wires in each group may vary. The connectors are adapted for mating connection with a header. The connectors are adapted with electrical contacts connected to the wires to connect the wires to an array of conductive pins projecting through a bottom of the header.

According to U.S. Pat. No. 4,984,992, a cable connector comprises, respective groups of electrical wires terminated with electrical contacts in multiple housing blocks. The housing blocks are nested together in a housing.

Removable keys on a connector are disclosed in U.S. Pat. No. 4,773,881. The keys are joined to the connector by weakened areas. Each of the weakened areas can be broken to remove a selected key from the connector.

SUMMARY OF THE INVENTION

A feature of the invention resides in an electrical connector assembly constructed with a pivotable latch to impinge electrical connectors of different sizes.

Another feature of the invention pertains to a header is constructed with a pivotable latch of one size that will impinge connectors of different sizes that are inserted into the header.

According to another feature of the invention, a header is constructed with a pivotable latch on one side of the header, and keying elements on another side of the header to latch to and key opposite sides of a connector that is inserted into the header.

An electrical connector assembly according to the invention comprises, a header with side walls and a bottom through which conductive pins extend, a pivotable latch with a hook adapted to impinge electrical connectors of different sizes inserted into the header, and the latch being pivotally mounted on one side of the header to engage one of the sides of the connectors.

An embodiment of the invention will now be described by way of example with reference to the accompanying drawings, according to which:

DETAILED DESCRIPTION

Figure 1:
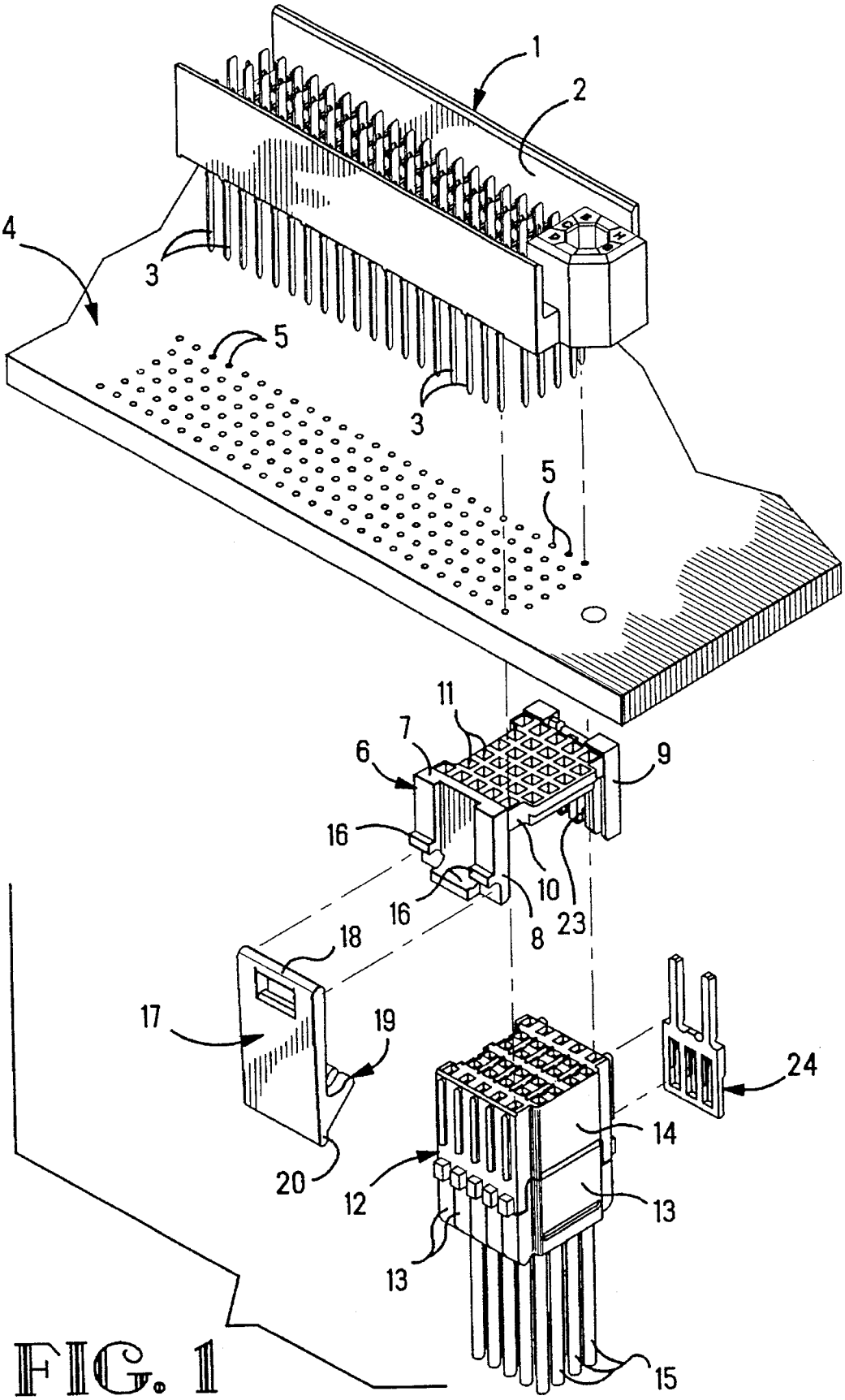
FIG. 1 is a perspective view of a connector assembly and a circuit board and an array of pins in another connector assembly, with parts separated from one another.

With reference to FIG. 1, an electrical connector assembly 1 comprises an insulating housing 2 and an array of conductive pins 3 arranged in a grid. The connector assembly 1 is mounted on a side of a circuit board 4. The pins 3 project from the housing 2 of the electrical connector assembly 1, and extend through apertures 5 in the circuit board 4. The pins 3 project from an opposite side of the circuit board 4.

Mounted on the circuit board 4 is an electrical connector assembly 6 that comprises; a channel shaped header 7 with side walls 8, 9 and a bottom 10 having an array of passages 11 through which the conductive pins 3 extend into the header 7. The electrical connector assembly 6 further comprises at least one electrical connector 12, of different sizes, as shown in FIGS. 2 through 5. The electrical connector 12 comprises, an insulating housing block 13 assembled with an insulating housing 14. Further details of the construction are disclosed in U.S. Pat. No. 4,984,992. According to such construction, respective groups of electrical conductors or wires 15 are terminated with electrical contacts, not shown, in respective housing blocks 13 for each group of wires 15. The connector 12, being adapted with the electrical contacts, not shown, connect the wires 15 to respective pins 3 that are arranged in a row of the grid, and that project through the bottom 10 of the header 7.

Figure 2:
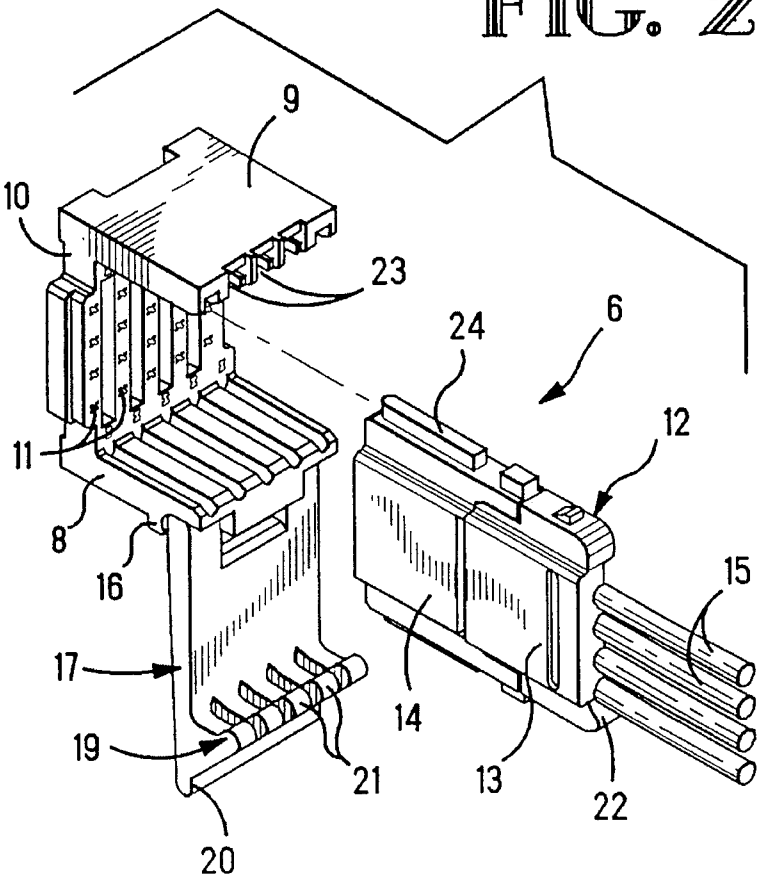
FIG. 2 is a perspective view of a connector assembly with parts separated from one another, and comprising a header and a group of wires connected with an electrical connector.

The electrical connectors 12 may be constructed in different sizes due to variations in the multiples of four electrical conductors or wires 15 being terminated by the connector 12. For example, as shown in FIGS. 2 and 4, a group of four conductors or wires 15 are being terminated, whereas, in FIGS. 3 and 5, a group of twenty conductors or wires 15 are being terminated. According to the electrical connector assembly 6, electrical connectors 12 of different sizes are connected to respective groups of electrical conductors or wires 15.

Figure 3:
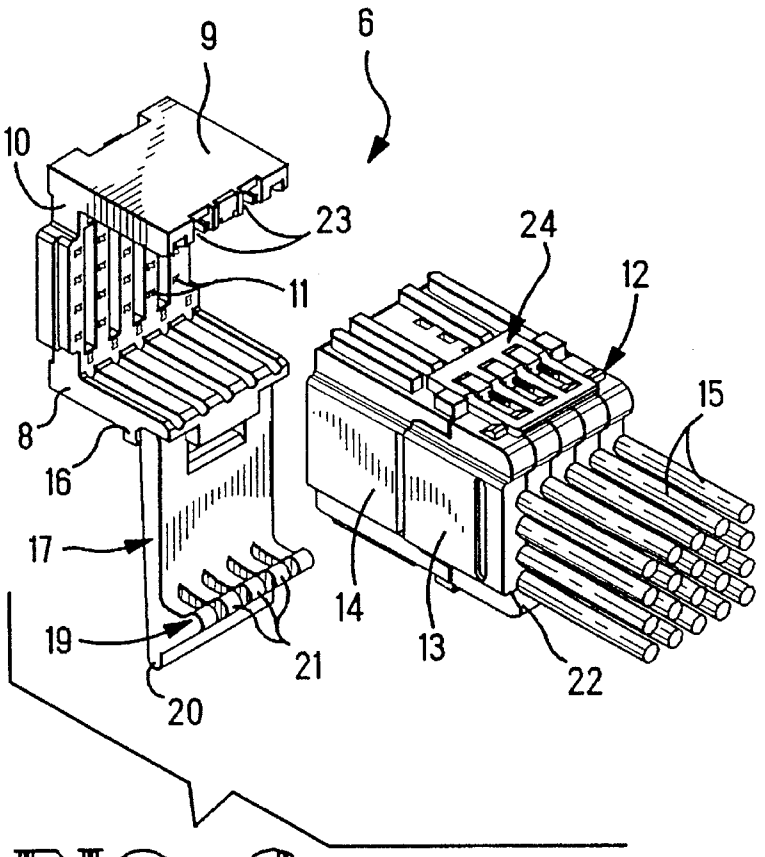
FIG. 3 is a perspective view of the header as shown in FIG. 2 and another, larger group of wires connected with a corresponding electrical connector of larger size than the connector as shown in FIG. 2.
Figure 4:
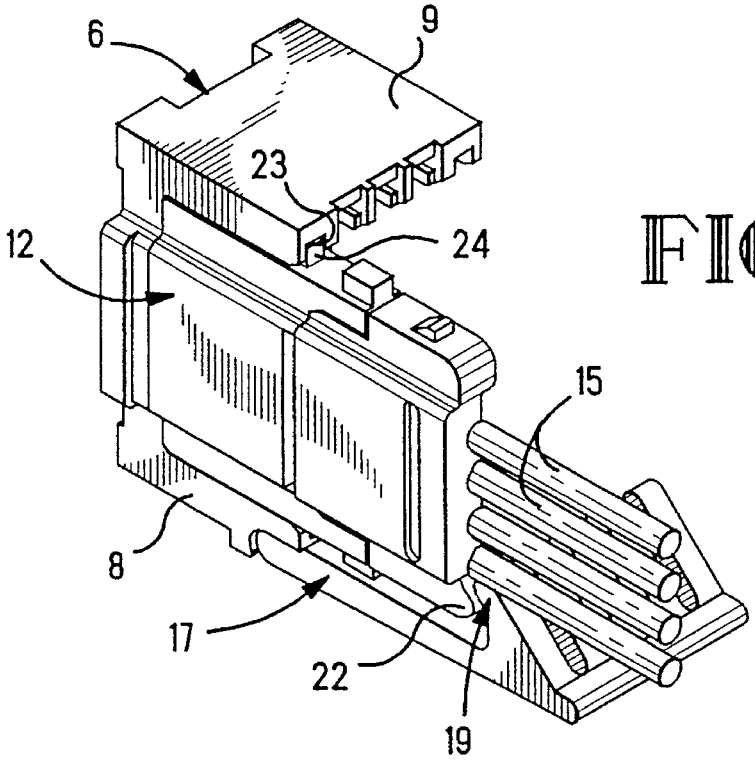
FIG. 4 is a perspective view of a connector assembly as shown in FIG. 2, with parts assembled together and latched.

With reference to FIGS. 1–3, the header 7 is of one piece molded polymer construction. Along a first exterior side 8 of the header 7 project integral, curved, spaced apart, hinge knuckles 16. A separate latch 17 having at one end a cylindrical hinge pin 18, and at an opposite end, a curved hook 19 pivotable about the hinge pin 18 that extends through the knuckles 16. A lever 20 projects diagonally from the hook 19, and is grasped to pivot the hook 19 about the hinge pin 18. The hinge pin 18 rotates in the fixed hinge knuckles 16. The hinge pin 18 is snap fit into open sides of the hinge knuckles 16 that alternate with one another on opposite sides of the hinge pin 18, and that are curved in opposite directions partially encircling the hinge pin 18. The hook 19 has a width that extends parallel to the hinge pin 18 and transversely of multiple rows of the pins 3.

Figure 5:
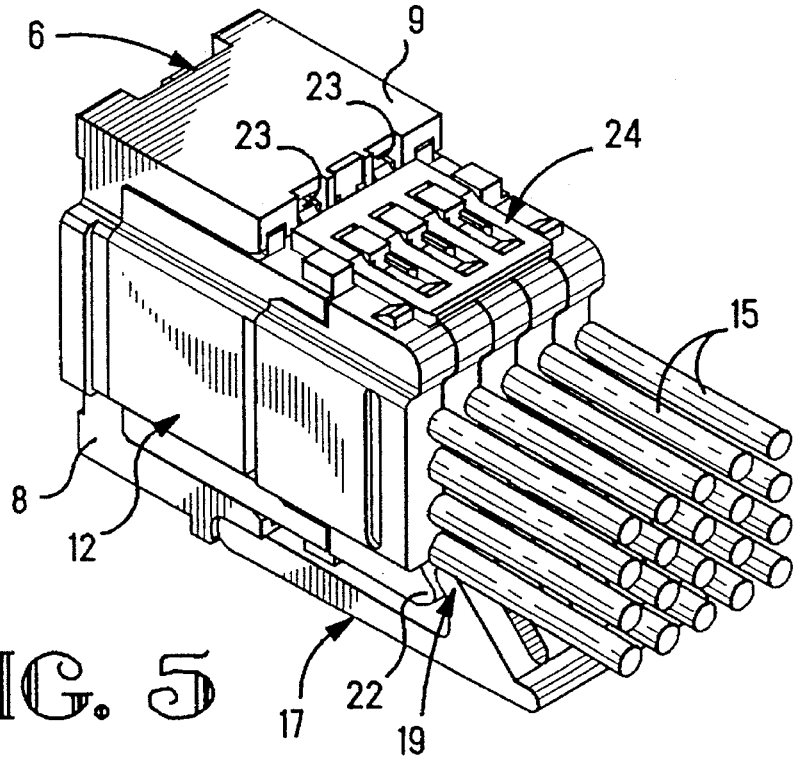
FIG. 5 is a perspective view of a connector assembly as shown in FIG. 3, with parts assembled together and latched.

The hook 19 is adapted to impinge at least one connector 12. The housing block 13 being assembled in a housing 14 having a width covering at least one row of the pins 3, as appearing in FIGS. 2 and 4. The hook 19 extends transverse to multiple rows of the pins 3. The hook 19 is as wide as the breadth of five rows of pins 3. The hook 19 can impinge multiple connectors 12 that nest together in the header 7 and cover the same five rows of pins 3. The hook 19 can impinge at least one connector 12 having a width covering more than one row of pins 3, for example, the cable connector 12, as shown in FIGS. 3 and 5, covering five rows of pins 3. The hook 19 is divided into a series of hook teeth 21. Each of the hook teeth 21 is opposite a row of the pins 3. Collectively, the teeth 21 corresponding in number to the number of rows of pins 3 covered by each housing 14 being impinged by the hook 19. Each connector 12 is constructed with a unitary ledge 22 along said housing block 13 onto which the hook 19 is impinged to retain said connector 12 in the header 7. At least one of the hook teeth 21 impinges the ledge 22 of the connector 12.

Keying elements 23 in the form of a series of parallel keyways are in at least one of the walls 9 of the header 7. At least one external key 24 is assembled on the connector 12 to connect with at least one of the keying elements 23, and align the connector 12 in the header 7 for connection to the pins 3. The latch 17 and the keying elements 23 are on different walls 8 and 9. According to a feature of the invention, the header 7 is constructed with a pivotable latch 17 on one side 8 of the header 7, and keying elements 23 on another side 9 of the header 7 to latch to and key opposite sides of a connector 12 that is inserted into the header 7.

Another feature of the invention resides in an electrical connector assembly 6 constructed with a pivotable latch 17 to impinge electrical connectors 12 of different sizes.

Another feature of the invention pertains to a header 7 constructed with a pivotable latch 17 of one size that will impinge connectors 12 of different sizes that are inserted into the header 7.

Other embodiments and modifications of the invention, and accompanying advantages, are intended to be included in the spirit and scope of the claims.

We claim:

1. An electrical connector assembly comprising: a header with side walls and a bottom through which conductive pins extend, a series of parallel keyways in at least one of the walls of the header, an electrical connector for connection to some of the pins, at least one external key on the connector being received along one of the keyways to align the connector for connection with selected pins, hinge knuckles along the header, a hook pivotable along a hinge pin extending through the knuckles, the hook extending parallel to the hinge pin and transversely of multiple rows of pins and being adapted to impinge a first connector covering only one row of pins, or to impinge a second connector covering more than one row of pins, and at least one connector and electrical contacts in the connector connected to wires, the contacts being connected with respective pins, and a ledge along said connector onto which the hook is impinged to retain said connector in the header, the hook being divided into a series of hook teeth corresponding in number to the number of rows of pins covered by said connector.

2. An electrical connector assembly as recited in claim 1, wherein, each of the hook teeth is opposite a row of the pins.

3. An electrical connector assembly as recited in claim 1, wherein, at least one of the hook teeth impinges the legde of the connector.

4. An electrical connector assembly comprising: a header with side walls and a bottom through which conductive pins extend, keying elements in at least one of the walls of the header, an insulating housing having at least one external key received by at least one of the keying elements to align the connector, hinge knuckles along the header, a hook pivotable along a hinge pin extending through the knuckles, a first connector having a width covering one row of pins, and a second connector having a width covering more than one row of pins, each said connector having a ledge, and the hook extending transverse to multiple rows of pins, the hook being pivotable about the hinge pin to bridge the width of either of said connectors, and to impinge the ledge of either of said connectors, the hook being divided into a series of hook teeth corresponding in number to the number of rows of pins covered by said connector.

5. An electrical connector assembly as recited in claim 4, wherein, each of the hook teeth is opposite a row of the pins.

6. An electrical connector assembly as recited in claim 4, wherein, at least one of the hook teeth impinges the legde of the connector.

7. An electrical connector assembly as recited in claim 4, comprising: a lever projecting from the hook.

8. An electrical connector assembly, comprising: a header with side walls and a bottom through which conductive pins extend, keying elements in at least one of the walls of the header, an electrical connector for connection to some of the pins, at least one external key being received by portions of the keying elements to align the connector for connection with selected pins, hinge knuckles along the header, a hook pivotable along a hinge pin extending through the knuckles, the hook extending parallel to the hinge pin and transversely of multiple rows of pins and being adapted to impinge a first connector covering only one row of pins, or to impinge a second connector covering more than one row of pins, the hook being divided into a series of hook teeth corresponding in number to the number of rows of pins covered by said connector.

9. An electrical connector assembly as recited in claim 8, wherein, each of the hook teeth is opposite a row of pins.

10. An electrical connector assembly as recited in claim 8, wherein, at least one of the hook teeth impinges a ledge on the connector.

* * * * *